US012186614B2

(12) United States Patent
Tayar

(10) Patent No.: US 12,186,614 B2
(45) Date of Patent: Jan. 7, 2025

(54) FITNESS DEVICE

(71) Applicant: Eliahu Tayar, Afula Illit (IL)

(72) Inventor: Eliahu Tayar, Afula Illit (IL)

( * ) Notice: Subject to any disclaimer, the term of this patent is extended or adjusted under 35 U.S.C. 154(b) by 165 days.

(21) Appl. No.: 17/850,395

(22) Filed: Jun. 27, 2022

(65) Prior Publication Data

US 2023/0001260 A1 Jan. 5, 2023

(30) Foreign Application Priority Data

Jul. 4, 2021 (IL) ..... 284597

(51) Int. Cl.
*A63B 21/00* (2006.01)
*A63B 21/02* (2006.01)
*A63B 21/055* (2006.01)

(52) U.S. Cl.
CPC ..... *A63B 21/156* (2013.01); *A63B 21/023* (2013.01); *A63B 21/055* (2013.01)

(58) Field of Classification Search
CPC ... A63B 21/156; A63B 21/023; A63B 21/055; A63B 7/045; A63B 21/018; A63B 21/169; A63B 21/4035; A63B 21/4043; A63B 21/00069
See application file for complete search history.

(56) References Cited

U.S. PATENT DOCUMENTS 6,029,777 A * 2/2000 Rogelja ..... A62B 1/14 182/5
7,018,323 B1 * 3/2006 Reynolds ..... A63B 23/1209 482/37
7,060,003 B1 * 6/2006 Reynolds ..... A63B 7/04 482/37
7,303,506 B1 * 12/2007 Reynolds ..... A63B 23/12 482/37
9,421,413 B2 * 8/2016 Staten ..... A63B 21/00185
9,764,177 B2 * 9/2017 Baudhuin ..... A63B 23/1209
11,141,621 B2 * 10/2021 Kushner ..... A63B 21/4043
2003/0013585 A1 1/2003 Chen
2003/0153441 A1 8/2003 Berns et al.
2004/0058789 A1 3/2004 Tsai
2005/0148437 A1 * 7/2005 Ryan ..... A63B 23/03525 482/37
2007/0151805 A1 * 7/2007 Betcher ..... A62B 35/0093 182/239
2008/0318740 A1 * 12/2008 Ross ..... A63B 21/063 482/92

(Continued)

FOREIGN PATENT DOCUMENTS

FR 1333776 A 8/1963
NO 328781 B1 5/2010

*Primary Examiner* — Andrew S Lo
(74) *Attorney, Agent, or Firm* — William H. Dippert; Laurence A. Greenberg; Werner H. Stemer

(57) ABSTRACT

A fitness device comprises a force applicator comprising: a rope, a base; a first fixed wheel positioned under the rope; a second fixed wheel positioned under the rope, wherein the second fixed wheel is substantially in line with the first fixed wheel; and a movable wheel positioned above the rope and above and between the first fixed wheel and the second fixed wheel, the movable wheel comprising a movable center configured to move either toward, or away from, the first fixed wheel and the second fixed wheel, and is configured to allow rotation of the movable wheel about the movable center.

15 Claims, 6 Drawing Sheets

(56) References Cited

U.S. PATENT DOCUMENTS

| | | | | |
|---|---|---|---|---|
| 2009/0137370 | A1* | 5/2009 | Kushnir | A63B 21/151 482/120 |
| 2010/0041520 | A1* | 2/2010 | Popescu | A63B 23/1209 482/37 |
| 2010/0204024 | A1 | 8/2010 | Mills et al. | |
| 2013/0296146 | A1* | 11/2013 | Staten | A63B 21/154 482/120 |
| 2016/0287922 | A1* | 10/2016 | Baudhuin | A63B 21/012 |
| 2017/0157448 | A1* | 6/2017 | Shavell | A63B 21/08 |
| 2018/0021616 | A1* | 1/2018 | Orady | A63B 21/16 482/5 |
| 2019/0175972 | A1* | 6/2019 | Small | A63B 21/157 |
| 2022/0339481 | A1* | 10/2022 | Peal | H02P 1/166 |

* cited by examiner

FITNESS DEVICE

CROSS-REFERENCE TO RELATED APPLICATION

This application is based upon and claims priority to Israeli Patent Application No. 284597, filed Jul. 4, 2021, the entire contents of which is incorporated herein by reference in its entirety.

FIELD OF THE INVENTION

The present subject matter relates to fitness devices. More particularly, the present subject matter relates to fitness devices configured to apply counter force on a rope.

BACKGROUND OF THE INVENTION

Fitness devices are used worldwide during exercise aimed at increasing the physical fitness of a user of these fitness devices. Some fitness devices prompt the user to exert force, for example with the hands or legs in order to develop muscle strength.

SUMMARY OF THE INVENTION

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

According to one aspect of the present subject matter, there is provided a fitness device, comprising a force applicator, the force applicator comprising:

a base;

a first fixed wheel comprising a first center pivotally fixed to the base, and configured to allow rotation of the first fixed wheel about the first center;

a second fixed wheel comprising a second center pivotally fixed to the base, and configured to allow rotation of the second fixed wheel about the second center, wherein the second fixed wheel is substantially in line with the first fixed wheel; and a movable wheel positioned above and between the first fixed wheel and the second fixed wheel, and comprising a movable center configured to move either toward, or away from, the first fixed wheel and the second fixed wheel, and is configured to allow rotation of the movable wheel about the movable center, wherein the force applicator is configured to accommodate a rope above the first fixed wheel and the second fixed wheel and under the movable wheel, in a manner that allows application of a counter force on the rope when the movable wheel moves toward the first fixed wheel and the second fixed wheel, and release of the counter forced applied on the rope when the movable wheel moves away from the first fixed wheel and the second fixed wheel.

According to one embodiment, the fitness device further comprising the rope.

According to another embodiment, the movable wheel is configured to move by a motor connected to the movable center of the movable wheel.

According to yet another embodiment, the motor is an electric motor.

According to still another embodiment, the movable wheel is configured to move manually.

According to a further embodiment, the base comprising a rail configured to accommodate the movable center of the movable wheel and allow sliding of the movable center along the rail, toward, and away from, the first fixed wheel and the second fixed wheel.

According to yet a further embodiment, the movable wheel comprising a handle attached to the movable center of the movable wheel, and configured to be held by a user and assist the user to move the movable wheel toward, or away from, the first fixed wheel and the second fixed wheel.

According to still a further embodiment, the movable wheel further comprising an extended handle that is attached to the movable center, wherein the extended handle extends beyond boundaries of a part of the force applicator that is covered.

According to an additional embodiment, the extended handle is a screwed handle.

According to yet an additional embodiment, the force applicator further comprising a fixing element attached to the base and configured to fix the screwed handle to the base, and a nut configured to screw on the screwed handle.

According to still an additional embodiment, the fixing element is hollow and is configured to accommodate the screwed handle in a hollow part of the fixing element.

According to another embodiment, the nut is prevented from moving along the screwed handle when turned about the screwed handle by being blocked by the fixing element.

According to yet another embodiment, the force applicator further comprising an elastic element, placed between the nut and the fixing element.

According to still another embodiment, the elastic element is a spring.

According to a further embodiment, the elastic element has a tube-like structure, and it is placed between the nut and the fixing element by inserting the screwed handle into an inner space of the tube-like elastic element.

According to yet a further embodiment, the rope is linear, having to edges.

According to still a further embodiment, the rope is closed circular.

According to an additional embodiment, the force applicator further comprising a cover configured to attach to the base while enclosing at least one of the first fixed wheel, the second fixed wheel, the movable wheel.

According to yet an additional embodiment, the cover is configured to removably attach to the base.

According to still an additional embodiment, the cover is attached to the base by using screws and corresponding nuts.

According to another embodiment, the cover and the base comprising holes in order to facilitate passage of the screws through the holes.

According to yet another embodiment, the fitness device further comprising an attaching element configured to attach the fitness device to a surface or an object, wherein the attaching element is attached to the base, or to the cover, or to both the base and the cover.

According to still another embodiment, the attaching element is removably attached to the base, or to the cover, or to both the base and the cover.

According to a further embodiment, the attaching element is permanently attached to the base, or to the cover, or to both the base and the cover.

According to still a further embodiment, the attaching element has a hook-like structure so as to enable the attaching element to attach to a corresponding nail, or hook, that is attached to the surface, or object.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF THE PREFERRED EMBODIMENTS

Figure 1:
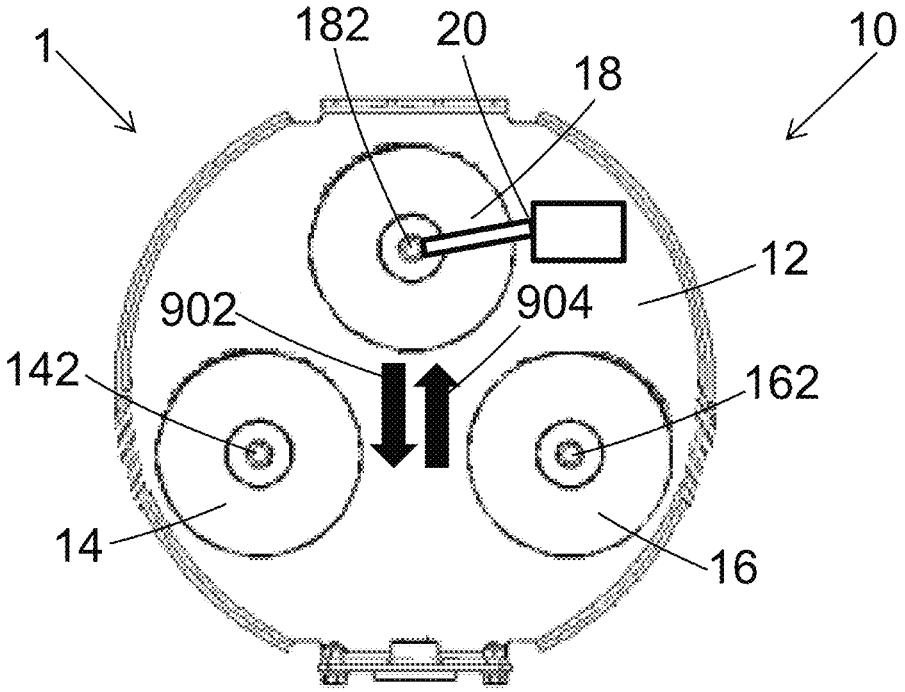
FIG. 1 schematically illustrates, according to an exemplary embodiment, a front view of a fitness device comprising a force applicator.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

The present subject matter provides a fitness device, comprising a force applicator configured to apply counter force on a rope, thus prompting a user to exert force in order to successfully pull the rope. According to this embodiment, the fitness device comprises only the force applicator, and the rope can be provided separately by a user. According to another embodiment, the fitness device further comprises the rope. According to yet another embodiment, the force applicator is configured to allow the user to control the level of counter force applied on the rope. This embodiment allows the user to control the level of force that has to be exerted by the user in order to successfully pull the rope.

It should be noted that some of the components of the fitness device shown in the following drawings, are optional, and can be a part of the fitness device in various combinations, as could be understood from the description of these components, even though all the optional components are shown in the same drawing.

Referring now to FIG. 1, schematically illustrating, according to an exemplary embodiment, a front view of a fitness device comprising a force applicator. The fitness device 1 shown in FIG. 1 comprises only the force applicator 10, thus indicating that the rope can be supplied separately. According to one embodiment, the force applicator 10 comprises

- a base 12;
- a first fixed wheel 14 comprising a first center 142 pivotally fixed to the base 12, and configured to allow rotation of the first fixed wheel 14 about the first center 142;
- a second fixed wheel 16 comprising a second center 162 pivotally fixed to the base 12, and configured to allow rotation of the second fixed wheel 16 about the second center 162, wherein the second fixed wheel 16 is substantially in line with the first fixed wheel 14; and
- a movable wheel 18 positioned above and between the first fixed wheel 14 and the second fixed wheel 16, and comprising a movable center 182 configured to move either toward 192, or away from 194, the first fixed wheel 14 and the second fixed wheel 16, and is configured to allow rotation of the movable wheel 18 about the movable center 182, wherein the force applicator 10 is configured to accommodate a rope above the first fixed wheel 14 and the second fixed wheel 16 and under the movable wheel 18, in a manner that allows application of a counter force on the rope when the movable wheel 18 moves toward the first fixed wheel 14 and the second fixed wheel 16, and release of the counter forced applied on the rope when the movable wheel 18 moves away from the first fixed wheel 14 and the second fixed wheel 16.

Figure 5:
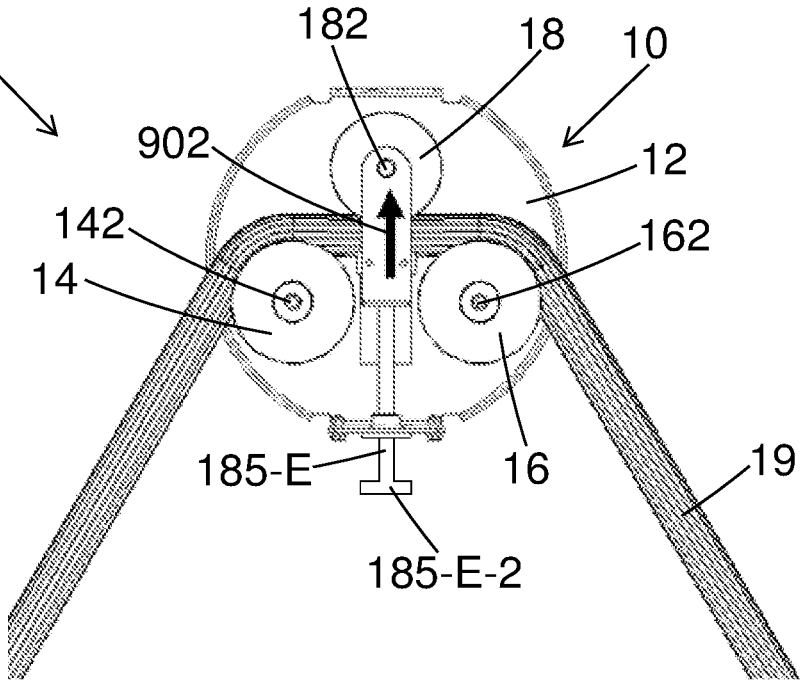
FIG. 5 schematically illustrates, according to an exemplary embodiment, a front view of a fitness device comprising a force applicator, and a rope accommodated in the force applicator, while a movable wheel is moved away from a first fixed wheel and a second fixed wheel.
Figure 6:
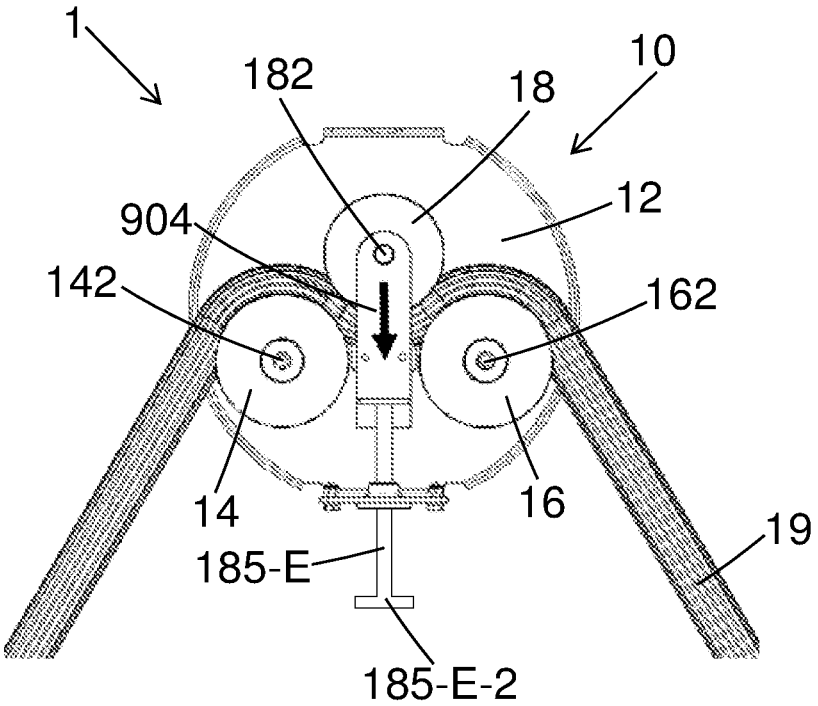
FIG. 6 schematically illustrates, according to an exemplary embodiment, a front view of a fitness device comprising a force applicator, and a rope accommodated in the force applicator, while a movable wheel is moved toward a first fixed wheel and a second fixed wheel.

FIGS. 5-6 hereinafter, illustrate the manner in which the rope is accommodated in the force applicator 10.

In FIG. 1, arrow 902 indicates the direction of movement of the movable wheel 18 toward the first fixed wheel 14 and the second fixed wheel 16, and arrow 904 indicates the direction of movement of the movable wheel 18 away from the first fixed wheel 14 and the second fixed wheel 16.

The counter force that is applied on the rope prompts a user to exert force in order to successfully pull the rope, thus allowing the user to exercise and strengthen any muscle as desired by the user.

Figure 3:
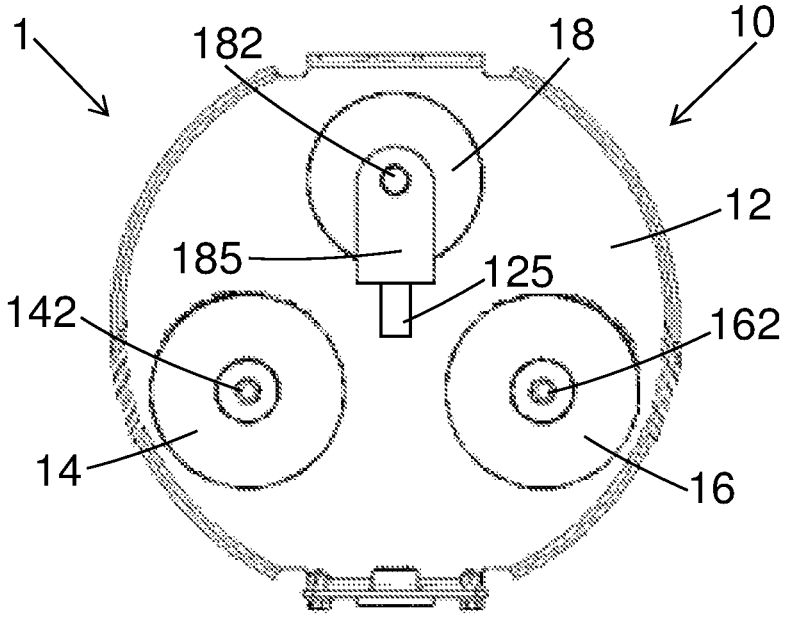
FIG. 3 schematically illustrates, according to an exemplary embodiment, a front view of a fitness device, further comprising a handle attached to a movable center of a movable wheel.

According to one embodiment, the base 12 can have any structure, as long as the base hold the first fixed wheel 14, the second fixed wheel 16 and the movable wheel 18 close one to the other in a manner that allows accommodation of a rope as shown in FIG. 3, hereinafter. Thus, it should be noted that the shape of the base 12 shown in FIG. 1, and the other drawings in the present application, is only exemplary and should not be considered as limiting the scope of the present subject matter.

According to one embodiment, the movable wheel 18 is configured to move by any mechanism. According to another embodiment, the movable wheel 18 is configured to move by a motor 20, for example an electric motor 20, to which the movable center 182 of the movable wheel 18 is connected. According to another embodiment, the movable wheel 18 is configured to move manually.

Figure 2:
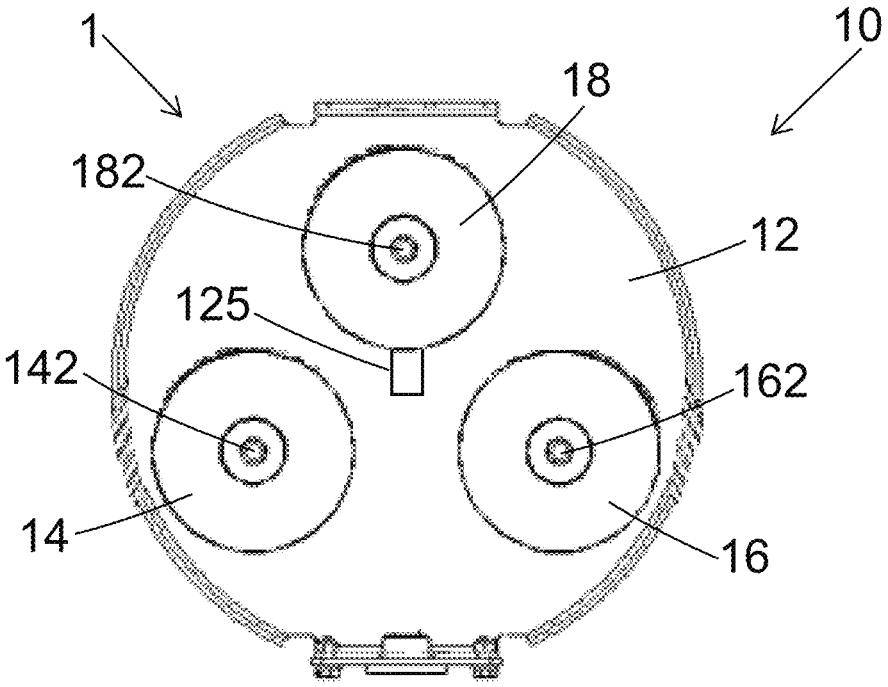
FIG. 2 schematically illustrates, according to an exemplary embodiment, a front view of a fitness device comprising a force applicator, further comprising a rail.

Referring now to FIG. 2, schematically illustrating, according to an exemplary embodiment, a front view of a fitness device comprising a force applicator, further comprising a rail. According to one embodiment, the base 185 comprises a rail 125 configured to accommodate the movable center 182 of the movable wheel 18 and allow sliding of the movable center 182 along the rail 125, toward, and away from, the first fixed wheel 14 and the second fixed wheel 16.

Referring now to FIG. 3, schematically illustrating, according to an exemplary embodiment, a front view of a fitness device, further comprising a handle attached to a movable center of a movable wheel. According to one embodiment, the movable wheel 18 comprises a handle 185 attached to the movable center 182 of the movable wheel 18, and configured to be held by a user and assist the user to move the movable wheel 18 toward, or away from, the first fixed wheel 14 and the second fixed wheel 16. According to this embodiment, the handle 185 is relatively small and is accessible by the user if the force applicator 10 is at least partially open, and at least the handle 185 is exposed.

It should be noted that the handle 185, and any other type of handle that is described hereinafter, is attached to the movable center 182 of the movable wheel 18 that is configured to move by a motor 20, for example as a backup, in case the motor 20 fails to operate; as well as manually.

Figure 4:
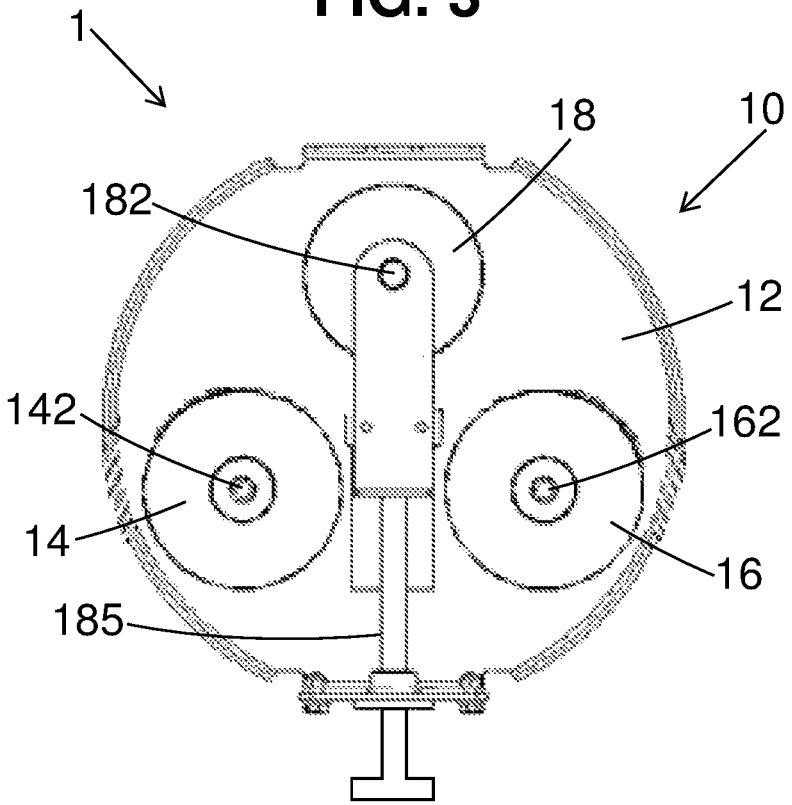
FIG. 4 schematically illustrates, according to an exemplary embodiment, a front view of a fitness device, further comprising an extended handle attached to a movable center of a movable wheel.

Referring now to FIG. 4, schematically illustrating, according to an exemplary embodiment, a front view of a fitness device, further comprising an extended handle attached to a movable center of a movable wheel. According to an embodiment that will be described later, the force applicator 10 is completely covered, or at least the movable wheel 18 is covered, and there can be no access to the handle 185 illustrated in FIG. 3. Therefore, according to the embodiment shown in FIG. 4, the movable wheel 18 further comprises an extended handle 185-E that is attached to the movable center 182, wherein the extended handle 185-E extends beyond boundaries of the force applicator 10, or more particularly, beyond boundaries of the base 12, or even more particularly, beyond boundaries of a part of the force applicator 10 that is covered. This allows manual movement of the movable wheel 18 also when at least the movable wheel 18 is covered.

Referring now to FIG. 5, schematically illustrating, according to an exemplary embodiment, a front view of a fitness device comprising a force applicator, and a rope accommodated in the force applicator, while a movable wheel is moved away from a first fixed wheel and a second fixed wheel. According to the embodiment shown in FIGS. 1-4, the fitness device 1 can comprise only the force applicator 10, and the rope can be provided separately and accommodated in the force applicator 10 as shown in FIG. 5, as described above. According to another embodiment, the fitness device 1 comprise the force applicator 10 and the rope 19 accommodated in the force applicator 10, as shown in FIG. 5, and described above. In other words, the fitness device 1 further comprises the rope 19. Thus, it is to be understood that in one hand the fitness device 1 can comprises the force applicator 10, and the rope 19 is to be provided independently by the user; or on the other hand, the fitness device 1 can comprises the force applicator 10 and the rope 19, as shown for example in FIG. 5.

It should be noted also that the force applicator 10 illustrated in FIG. 5 comprises the extended handle 185-E that is attached to the movable center 182 of the movable wheel 18. However, this should not be considered as limiting the scope of the present subject matter. Any embodiment of the force applicator 10 described herein can accommodate the rope 19 as shown in FIG. 5, and the drawings hereinafter.

FIG. 5 further shows the movable wheel 18 moved away from the first fixed wheel 14 and the second fixed wheel 16, as indicated with arrow 902. According to the embodiment where an extended handle 185-E is attached to the movable center 182 of the movable wheel 18, there can be seen in FIG. 5 that an edge 185-E-2 of the extended handle 185-E is close to the base 12.

Referring now to FIG. 6, schematically illustrating, according to an exemplary embodiment, a front view of a fitness device comprising a force applicator, and a rope accommodated in the force applicator, while a movable wheel is moved toward a first fixed wheel and a second fixed wheel. FIG. 6 is similar to FIG. 5, except that the movable wheel 18 is moved toward the first fixed wheel 14 and the second fixed wheel 16, as indicated with arrow 904. According to the embodiment where an extended handle 185-E is attached to the movable center 182 of the movable wheel 18, there can be seen in FIG. 6 that the edge 185-E-2 of the extended handle 185-E is more distant from to the base 12, compared to FIG. 5.

When the movable wheel 18 is moved toward the first fixed wheel 14 and the second fixed wheel 16, the rope 19 is pressed between the movable wheel 18 and the first fixed wheel 14 and the second fixed wheel 16, as shown in FIG. 6. As a result, a counter force is applied on the rope 19, and this prompts the user that attempts to pull the rope 19, to apply a high degree of force in order to pull the rope 19, thus strengthening muscles that are involved in the pulling of the rope 19. On the other hand, when the movable wheel 18 is moved away from the first fixed wheel 14 and the second fixed wheel 16, as shown in FIG. 5, the rope 19 is not pressed, no counter force is applied on the rope 19, and there is no need to exert a high degree of force by the user in order to successfully pull the rope 19. However, the distance in which the movable wheel 18 can move can be controlled by the user. The more close the movable wheel 18 is to the first fixed wheel 14 and the second fixed wheel 16, the higher counter force is applied on the rope 19, and vice versa. The more distant is the movable wheel 18 from the first fixed wheel 14 and the second fixed wheel 16, the lower counter force is applied on the rope 19.

In each of the aforementioned embodiments, the distance in which the movable wheel 18 moves, toward or away from, the first fixed wheel 14 and the second fixed wheel 16, can be controlled by the user. According to the embodiment in which the movement of the movable wheel 18 is controlled by a motor 20, a user can control the time, or speed, or both the time and speed, as well as the direction, in which the motor 20 operates in order to control the movement of the movable wheel toward, or away from, the first fixed wheel 14 and the second fixed wheel 16. According to the other embodiment, in which a handle 185, or an extended handle 185-E, is attached to the movable center 182 of the movable wheel 18, the user can hold the holder 185, or the extended holder 185-E, and move the movable wheel 18 as desired. For example, according to the embodiment of the extended handle 185-E that is attached to the movable center 182 of the movable wheel 18, pulling the extended handle 185-E in direction 904, as shown in FIG. 6, moves the movable wheel 18 toward the first fixed wheel 14 and the second fixed wheel 16, thus increasing the counter force applied on the rope 19. On the other hand, pushing the extended handle 185-E in direction 902, as shown in FIG. 5, moves the movable wheel 18 away from the first fixed wheel 14 and the second fixed wheel 16, thus decreasing the counter force applied on the rope 19.

Figure 7:
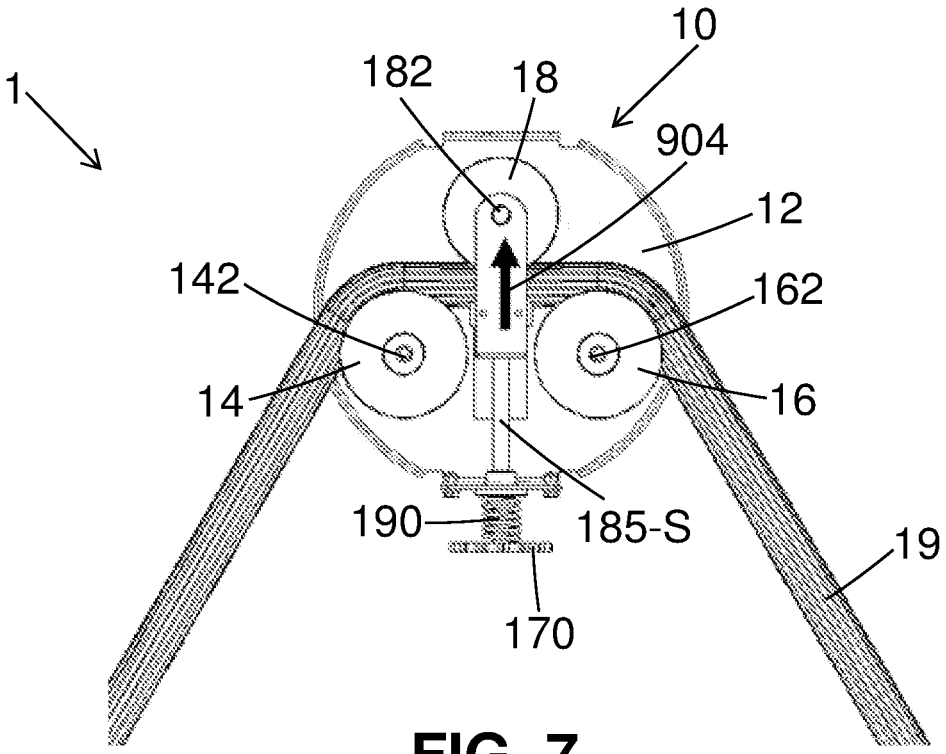
FIG. 7 schematically illustrates, according to an exemplary embodiment, a front view of a fitness device comprising a force applicator, and a rope accommodated in the force applicator, while a movable wheel is moved away from a first fixed wheel and a second fixed wheel by using a screwed handle attached to a movable center of the movable wheel.

Referring now to FIG. 7, schematically illustrating, according to an exemplary embodiment, a front view of a fitness device comprising a force applicator, and a rope accommodated in the force applicator, while a movable wheel is moved away from a first fixed wheel and a second fixed wheel by using a screwed handle attached to a movable center of the movable wheel. FIG. 7 illustrates another embodiment of the handle attached to the movable center 182 of the movable wheel 18. According to this embodiment, the handle extends beyond boundaries of the force applicator 10, or more particularly, beyond boundaries of the base 12, or even more particularly, beyond boundaries of a part of the force applicator 10 that is covered, and is also screwed. Therefore, according to one embodiment, the extended handle 185-E is a screwed handle 185-S.

According to one embodiment, the handle is a screwed handle 185-S, and the force applicator 10 further comprises a fixing element 122 attached to the base 12 and configured to fix the screwed handle 185-S to the base 12, and a nut 170 configured to screw on the screwed handle 185-S. According to this embodiment, the screwed handle 185-S is threaded, and the nut 170 is correspondingly threaded, thus allowing the nut 170 to screw onto the screwed handle 185-S. In addition, according to another embodiment, the fixing element 122 is hollow and is configured to accommodate the screwed handle 185-S in a hollow part of the fixing element 122. Therefore, since the fixing element 122 is fixed to the base 12, and accommodates the screwed handle 185-S, the screwed handle 185-S is fixed to the base 12. As a result, turning of the nut 170, while preventing the nut 170 from moving along the screwed handle 185-S, causes the screwed handle 185-S to rotate about a longitudinal axis of the screwed handle 185-S and move in relation to the nut 170.

Figure 8:
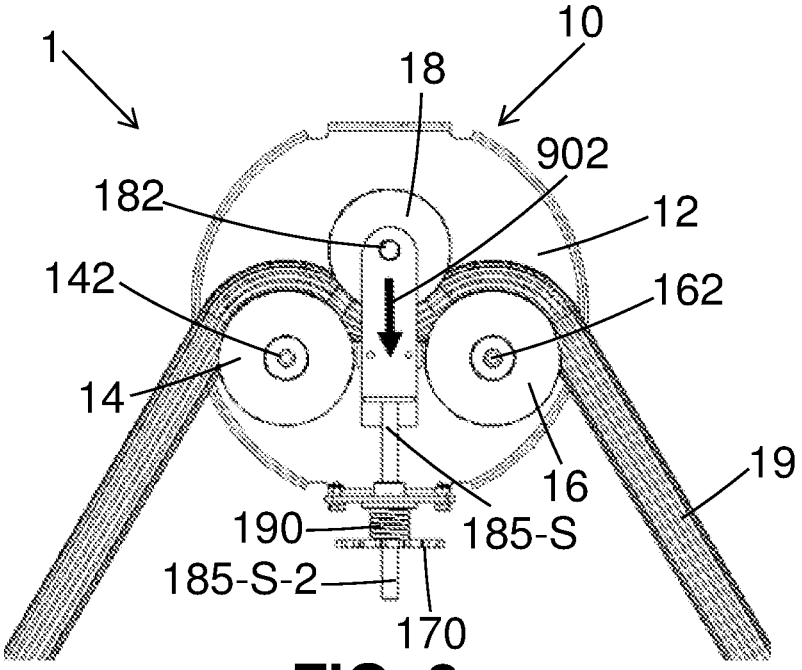
FIG. 8 schematically illustrates, according to an exemplary embodiment, a front view of a fitness device comprising a force applicator, and a rope accommodated in the force applicator, while a movable wheel is moved toward a first fixed wheel and a second fixed wheel by using a screwed handle attached to a movable center of the movable wheel.

According to one embodiment, the nut 170 is prevented from moving along the screwed handle 185-S when turned about the screwed handle 185-S by being blocked by the fixing element 122. This embodiment is preferably applicable when the fixing element 122 is attached to an edge of the base, as shown in FIG. 7. According to another embodiment, the force applicator 10 further comprises an elastic element 190, placed between the nut 170 and the fixing element 122. According to yet another embodiment, the elastic element 190 is a spring 190. According to yet another embodiment, the elastic element 190 is placed between the nut 170 and an edge of the base 12. According to still another embodiment, the elastic element 190 has a tube-like structure, and it is placed between the nut 170 and the fixing element 122 by inserting the screwed handle 185-S into an inner space of the tube-like elastic element 190. Thus, according to the embodiments of the force applicator 10 further comprising an elastic element 190 as described above, movement of the nut 170 along the screwed handle 185-S, when the nut 170 is turned, is prevented, and the result is movement of the screwed handle 185-S. In the embodiment illustrated in FIG. 7, the nut 170 was turned in a manner that caused the screwed handle 185-S to move in direction 904, and this caused the movable wheel 18 to move away from the first fixed wheel 14 and the second fixed wheel 16. FIG. 8, hereinafter, shows the opposite position of the movable wheel 18.

Referring now to FIG. 8, schematically illustrating, according to an exemplary embodiment, a front view of a fitness device comprising a force applicator, and a rope accommodated in the force applicator, while a movable wheel is moved toward a first fixed wheel and a second fixed wheel by using a screwed handle attached to a movable center of the movable wheel. In FIG. 8, the nut 170 was turned in a manner that caused the screwed handle 185-S to move in direction 902, and this caused the movable wheel 18 to move toward the first fixed wheel 14 and the second fixed wheel 16.

Comparison of FIG. 8 with FIG. 7 shows the movement of the screwed handle 185-S as a result of the turning of the nut 170. In FIG. 8, an edge 185-S-2 of the screwed handle is seen, protruding under the nut 170, as a result of the movement of the screwed handle 185-S downward, in direction 902. On the other hand, in FIG. 7 the edge 185-S-2 of the screwed handle 185-S is masked by the elastic element 190, because the screwed handle 185-S moved upward, in direction 904, as a result of the turning of the nut 170.

According to one embodiment, usage of the screwed handle 185-S, the nut 170, and optionally the elastic element 190, as described above, facilitate fine adjustment of the position of the movable wheel 18 in relation to the first fixed wheel 14 and the second fixed wheel 16, when the movable wheel 18 is moved manually. According to another embodiment, the elastic element 190 facilitates fine adjustment of the position of the movable wheel 18 in relation to the first fixed wheel 14 and the second fixed wheel 16, when the movable wheel 18 is moved manually. Both these embodiments are translated to fine adjustment of the counter force applied on the rope 19, which is advantageous per se.

According to one embodiment, the elastic element 190 is configured to facilitate pushing of the rope 19 by the user, particularly when a counter force is applied on the rope 19 by the first fixed wheel 14, the second fixed wheel 16 and the movable wheel 18. This embodiment is important when a contour, or surface, of the rope 19 is rough, or not homogenous. In other words, there can be bulges in various sizes and shapes on the surface of the rope 19. When the rope 19 is pressed between the movable wheel 18 and the first fixed wheel 14 and the second fixed wheel 16, the rope 19 can be stuck between the wheels because of the bulges on the surface of the rope 19. This is because the first fixed wheel 14 and the second fixed wheel 16, are fixed to the base 12, by nature. However, also when the movable wheel 18 is brought to a desired position, the movable wheel 18 is also fixed to the base 12. However, when the elastic element 190 is part of the force applicator 10, then, the elastic element 190 allows slight movement of the movable wheel 18 when a bulge on the surface of the rope 19 is encountered by the movable wheel 18. Thus, in one hand, the elastic element 190 allows smooth path of the bulge between the first sixed wheel 14, the second fixed wheel 16, and the movable wheel 18 due to a slight movement of the movable wheel 18 facilitated by the elastic element 190; while on the other hand, the elastic element 190 absorbs rotations of the movable wheel 18 due to the bulges on the surface of the rope 19, when the rope 19 is pushed. In other words, the elastic element 190 serves as a shock absorber.

Figure 9:
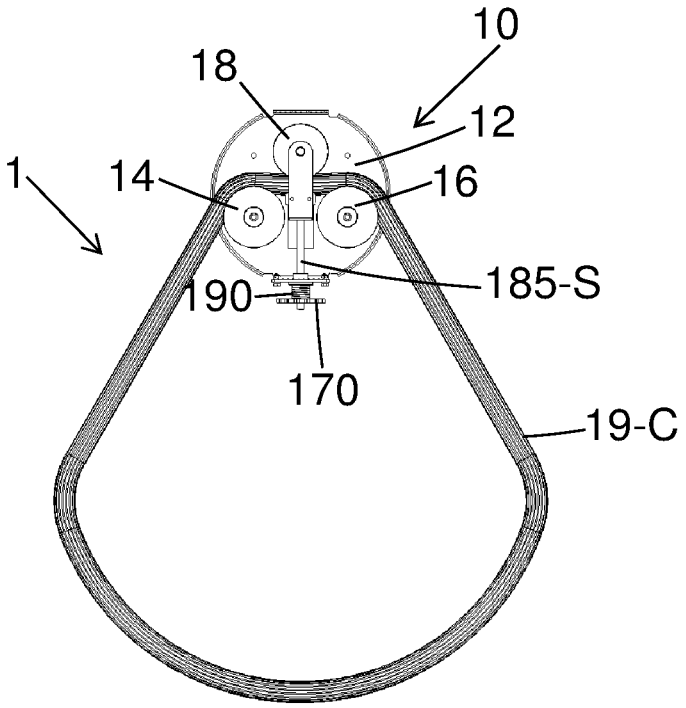
FIG. 9 schematically illustrates, according to an exemplary embodiment, a front view of a fitness device comprising a force applicator, and a closed circular rope, when a movable wheel is moved away from a first fixed wheel and a second fixed wheel.

Referring now to FIG. 9, schematically illustrating, according to an exemplary embodiment, a front view of a fitness device comprising a force applicator, and a closed circular rope, when a movable wheel is moved away from a first fixed wheel and a second fixed wheel. According to the embodiments illustrated in FIG. 5-8, the rope 19 is linear, having two edges. However, according to the embodiment illustrated in FIG. 9, the rope 19-C is closed circular. Again, as emphasized above in regard to the rope 19, also the closed circular rope 19-C can be part of the fitness device 1, together with the force applicator 10 in which the closed circular rope 19-C is accommodated. Alternatively, the fitness device 1 comprises only the force applicator 10, and the closed circular rope 19-C can be provided independently by the user.

It should be noted that the closed circular rope 19-C can be accommodated in any type of the force applicator 10 described herein. Therefore, FIG. 9, showing the closed circular rope 19-C accommodated in the force applicator 10 that comprises a screwed handle 185-S, a nut 170, and optionally an elastic element 190, should not be considered as limiting the scope of the present subject matter. The closed circular rope 19-C can be accommodated in any type of the force applicator 10 described herein.

Another embodiment that is shown in FIG. 9, relates to the position of the movable wheel 18. In FIG. 9 the movable wheel 18 is moved away from the first fixed wheel 14 and the second fixed wheel 16. As a result, the counter force applied on the closed circular rope 19-C is low, and the user does not have to strengthen his muscles in order to pull the closed circular rope 19-C. An opposite position of the movable wheel 18 is shown in FIG. 10.

Figure 10:
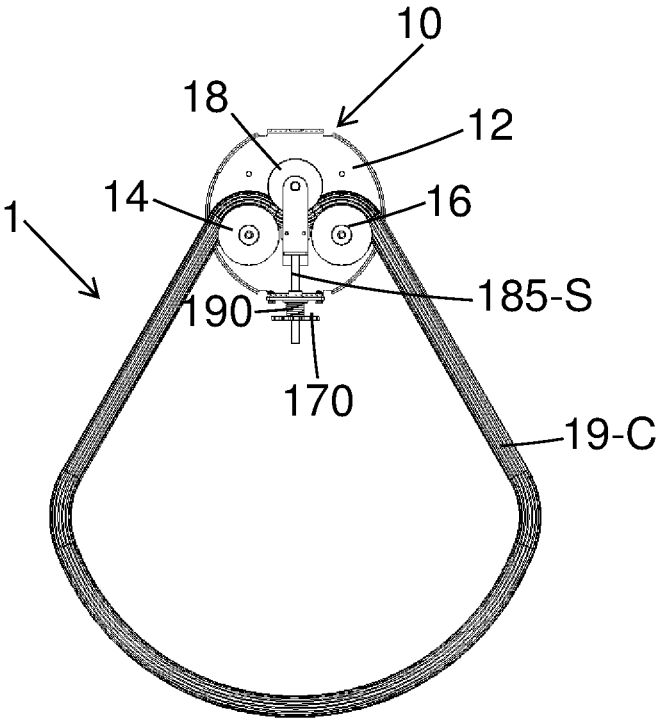
FIG. 10 schematically illustrates, according to an exemplary embodiment, a front view of a fitness device comprising a force applicator, and a closed circular rope, when a movable wheel is moved toward a first fixed wheel and a second fixed wheel.

Referring now to FIG. 10, schematically illustrating, according to an exemplary embodiment, a front view of a fitness device comprising a force applicator, and a closed circular rope, when a movable wheel is moved toward a first fixed wheel and a second fixed wheel. In FIG. 10, the movable wheel 18 is moved toward the first fixed wheel 14 and the second fixed wheel 16. As a result, the counter force applied on the closed circular rope 19-C is high, and the user has to strengthen his muscles in order to pull the closed circular rope 19-C.

Figure 11:
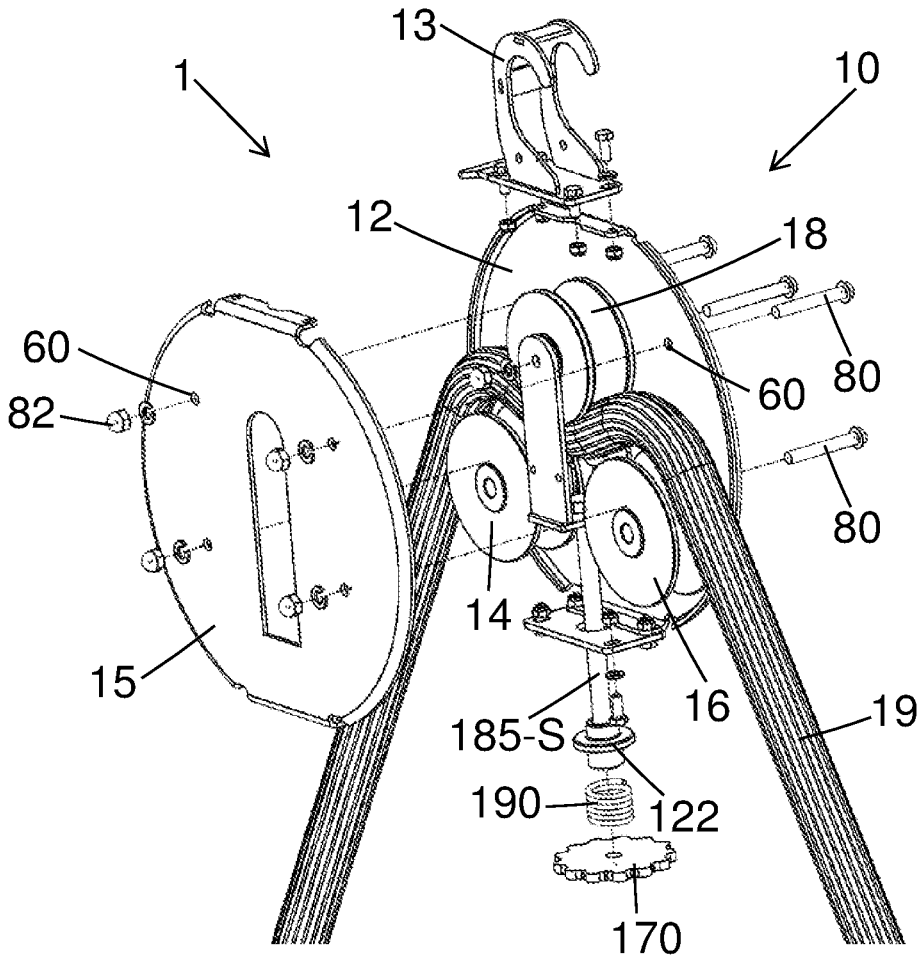
FIG. 11 schematically illustrates, according to an exemplary embodiment, a perspective exploded view of a fitness device comprising a force applicator and a rope.

Referring now to FIG. 11, schematically illustrating, according to an exemplary embodiment, a perspective exploded view of a fitness device comprising a force applicator and a rope. FIG. 11 shows components of the fitness device 1 that were described in detail above—the base 12, the first fixed wheel 14, the second fixed wheel 16, the movable wheel 18, the handle 185, which in the embodiment shown in FIG. 11, is the screwed handle 185-S, the fixing device 122, the bolt 170 and the elastic element 190. These components, as well as their functions and interrelations are described in detail above. However, FIG. 11 further shows some additional optional components.

Staying in FIG. 11, according to one embodiment, the force applicator 10 further comprises a cover 15 configured to attach to the base 12 while enclosing at least one of the first fixed wheel 14, the second fixed wheel 16, the movable wheel 18. According to another embodiment, the cover 15 is configured to removably attach to the base 12. This embodiment allows removal of the cover 15, for example for accommodating a rope 19 in between the first fixed wheel 14, the second fixed wheel 16 and the movable wheel 18; or for replacing a component, and the like. According to yet another embodiment, the cover 15 is configured to permanently attach to the base Still staying in FIG. 11, according to one embodiment, the cover 15 is attached to the base 12 by using screws 80 and corresponding nuts 82. For this embodiment, the cover 15 and the base 12 comprise holes 60 in order to facilitate passage of the screws 80 through the holes 60. Even though this embodiment is shown in FIG. 11, it should be noted that any mechanism for attaching the cover 15 to the base 12, either removably, or permanently, is under the scope of the present subject matter, for example usage of screws 80 and nuts 82 as shown in FIG. 11, adhering, welding, usage of any type of fasteners, clips, shape fitness of the cover 15 with the base 12 that allows attachment of the cover 15 to the base 12, and the like.

Still staying in FIG. 11, according to one embodiment, the fitness device 1 further comprises an attaching element 13 attached to the base 12, or to the cover 15, or to both the base 12 and the cover 15. According to one embodiment, the attaching element 13 is removably attached to the base 12, or to the cover, or to both the base 12 and the cover 15. According to one embodiment, the attaching element 13 is permanently attached to the base 12, or to the cover, or to both the base 12 and the cover 15. Any mechanism for attaching the attaching element 13 to the base 12, or to the cover 15, or to the base 12 and the cover 15, either removably, or permanently, is under the scope of the present subject matter, for example usage of screws 80 and nuts 82 as shown in FIG. 11, adhering, welding, usage of any type of fasteners, clips, shape fitness of the attaching element 13 with the cover 15, or the base 12, or both the cover 15 and the base 12 that allows attachment of the attaching element 13, and the like.

The attaching element 13 is configured to attach the fitness device 1 to a surface or an object, for example a floor, a wall, a ceiling, a pole, a piece of furniture, and the like. Thus, the shape of the attaching element 13 is adapted to the mechanism of attachment of the attaching element 13 to the surface or object. For example, the attaching element 13 illustrated in FIG. 11 is configured to be hanged from a surface or an object. Accordingly, the attaching element 13 has a hook-like structure so as to enable the attaching element 13 to attach to a corresponding nail, or hook, and the like that is attached to the surface, or object.

It is appreciated that certain features of the subject matter, which are, for clarity, described in the context of separate embodiments, may also be provided in combination in a single embodiment. Conversely, various features of the subject matter, which are, for brevity, described in the context of a single embodiment, may also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A fitness device comprising:

a closed circular rope having a bulge, and a force applicator comprising:

a base;

a first fixed wheel positioned under the closed circular rope and comprising a first center pivotally fixed to the base, the first center configured to allow rotation of the first fixed wheel about the first center;

a second fixed wheel positioned under the closed circular rope and comprising a second center pivotally fixed to the base, the second center configured to allow rotation of the second fixed wheel about the second center, wherein the second fixed wheel is substantially in line with the first fixed wheel;

a movable wheel positioned above the closed circular rope and above and between the first fixed wheel and the second fixed wheel, and comprising a movable center configured to move either toward or away from the first fixed wheel and the second fixed wheel, and is configured to allow rotation of the movable wheel about the movable center, wherein the movable wheel further comprises a screwed handle attached to the movable center and extends beyond the base; and a fixing element attached to the base and configured to fix the screwed handle to the base, and a nut configured to screw onto the screwed handle, and an elastic element placed between the nut and the fixing element, wherein the closed circular rope is positioned above the first fixed wheel and the second fixed wheel and under the movable wheel, wherein when the bulge encounters the moving wheel, the moving wheel is configured to move away from the first fixed wheel and the second fixed wheel over the bulge, thereby causing the screwed handle and the nut to move towards the fixing element and the elastic element to contract, and wherein after the bulge passes the first fixed wheel and the second fixed wheel and the movable wheel, the elastic element is configured to expand and pull the nut and the screwed handle away from the fixing element and move the movable wheel towards the closed circular rope, thereby allowing the bulge on the closed circular rope to pass between the movable wheel and the first fixed wheel and the second fixed wheel.

2. The fitness device of claim 1, wherein the movable wheel is configured to move by a motor connected to the movable center of the movable wheel.

3. The fitness device of claim 2, wherein the motor is an electric motor.

4. The fitness device of claim 1, wherein the movable wheel is configured to move manually.

5. The fitness device of claim 1, wherein the base comprising a rail configured to accommodate the movable center of the movable wheel and allow sliding of the movable center along the rail, toward, and away from, the first fixed wheel and the second fixed wheel.

6. The fitness device of claim 1, wherein the movable wheel comprising a handle attached to the movable center of the movable wheel, and configured to be held by a user and assist the user to move the movable wheel toward, or away from, the first fixed wheel and the second fixed wheel.

7. The fitness device of claim 1, wherein the fixing element is hollow and is configured to accommodate the screwed handle in a hollow part of the fixing element.

8. The fitness device of claim 1, wherein the nut is prevented from moving along the screwed handle when turned about the screwed handle by being blocked by the fixing element.

9. The fitness device of claim 1, wherein the elastic element has a tube-like structure, and it is placed between the nut and the fixing element by inserting the screwed handle into an inner space of the tube-like elastic element.

10. The fitness device of claim 1, wherein the force applicator further comprises a cover configured to attach to the base while enclosing at least one of the first fixed wheel, the second fixed wheel, and the movable wheel.

11. The fitness device of claim 10, wherein the cover is configured to removably attach to the base.

12. The fitness device of claim 11, wherein the cover is attached to the base by using screws and corresponding nuts.

13. The fitness device of claim 1, further comprising an attaching element configured to attach the fitness device to a surface or an object, wherein the attaching element is attached to the base, or to a cover, or to both the base and the cover.

14. The fitness device of claim 13, wherein the attaching element is removably or permanently attached to the base, or to the cover, or to both the base and the cover.

15. A force applicator for a fitness device having a closed circular rope having a bulge, the force applicator comprising:

a base;

a first fixed wheel comprising a first center pivotally fixed to the base configured to allow rotation of the first fixed wheel about the first center;

a second fixed wheel comprising a second center pivotally fixed to the base configured to allow rotation of the second fixed wheel about the second center, wherein the second fixed wheel is substantially in line with the first fixed wheel;

a movable wheel positioned above and between the first fixed wheel and the second fixed wheel, and comprising a movable center configured to move either toward or away from the first fixed wheel and the second fixed wheel, and is configured to allow rotation of the movable wheel about the movable center, wherein the movable wheel further comprises a screwed handle attached to the movable center and extends beyond the base; and a fixing element attached to the base and configured to fix the screwed handle to the base, and a nut configured to screw onto the screwed handle, and an elastic element placed between the nut and the fixing element, wherein the closed circular rope is configured to be accommodated in the force applicator, and wherein the closed circular rope is positioned above the first fixed wheel and the second fixed wheel and under the movable wheel, wherein when the bulge encounters the moving wheel, the moving wheel is configured to move away from the first fixed wheel and the second fixed wheel over the bulge, thereby causing the screwed handle and the nut to move towards the fixing element and the elastic element to contract, and wherein after the bulge passes the first fixed wheel and the second fixed wheel and the movable wheel, the elastic element is configured to expand and pull the nut and the screwed handle away from the fixing element and move the movable wheel towards the closed circular rope, thereby letting the bulge on the closed circular rope to pass between the movable wheel and the first fixed wheel and the second fixed wheel.

* * * * *